US007272929B2

(12) United States Patent
Leavesley

(10) Patent No.: US 7,272,929 B2
(45) Date of Patent: Sep. 25, 2007

(54) VARIABLE TURBOCHARGER APPARATUS WITH BYPASS

(76) Inventor: Malcolm George Leavesley, 54 Heylyn Square, Malmesbury Road, Bow, London E3 2DW (GB)

( * ) Notice: Subject to any disclaimer, the term of this patent is extended or adjusted under 35 U.S.C. 154(b) by 0 days.

(21) Appl. No.: 10/535,217

(22) PCT Filed: Nov. 14, 2003

(86) PCT No.: PCT/GB03/04961

§ 371 (c)(1),
(2), (4) Date: May 17, 2005

(87) PCT Pub. No.: WO2004/048755

PCT Pub. Date: Jun. 10, 2004

(65) Prior Publication Data

US 2006/0037317 A1 Feb. 23, 2006

(30) Foreign Application Priority Data

Nov. 25, 2002 (GB) ..... 0227473.6

(51) Int. Cl.
*F02D 23/00* (2006.01)
*F04D 25/04* (2006.01)
*F01D 17/14* (2006.01)
*F01D 17/12* (2006.01)

(52) U.S. Cl. ..... 60/602; 415/158

(58) Field of Classification Search ..... 60/602; 415/157–159; *F01D 17/14; F04D 25/04*
See application file for complete search history.

(56) References Cited

U.S. PATENT DOCUMENTS 2,431,398 A * 11/1947 Hasbrouck ..... 415/157
4,802,817 A * 2/1989 Tyler ..... 415/157
5,441,383 A * 8/1995 Dale et al. ..... 415/158
5,855,117 A 1/1999 Schade et al. ..... 60/602
6,478,536 B2 * 11/2002 Doring et al. ..... 415/158
7,010,918 B2 * 3/2006 Ruess ..... 60/602
7,047,739 B2 * 5/2006 Fledersbacher et al. ..... 60/602

FOREIGN PATENT DOCUMENTS

DE 4303521 C1 * 1/1994
DE 199 24 228 12/2000 ..... 60/602
DE 10029807 C1 * 3/2002
DE 102004003208 A1 * 8/2005
DE 102004003209 A1 * 8/2005

(Continued)

*Primary Examiner*—Thai-Ba Trieu
(74) *Attorney, Agent, or Firm*—Iandiorio & Teska

(57) ABSTRACT

Variable turbocharger apparatus comprising a housing, a compressor, a turbine, a chamber which extends around the turbine, a bearing assembly for the turbine, vanes mounted in the chamber, a piston positioned between the housing and the turbine, a control device controlling the piston, a piston end nearest the bearing assembly defining a gap, which is variable in size to control exhaust gases acting on the turbine, at least one bypass aperture which opens to allow exhaust gases that are not required for acting on the turbine to bypass the turbine, and sliding of the piston being such that the piston is always maintained in a position which enables the turbine speed to be controlled through the gap alone when there is no bypass and through the gap and the bypass aperture when there is bypass.

26 Claims, 15 Drawing Sheets

FOREIGN PATENT DOCUMENTS

| | | | | |
|---|---|---|---|---|
| DE | 102004003210 | A1 * | 8/2005 | |
| DE | 102004003211 | A1 * | 8/2005 | |
| EP | 0 678 657 | | 10/1995 | ..... 60/602 |
| EP | 0 884 453 | | 12/1998 | |
| GB | 2 271 814 | | 4/1994 | |
| WO | WO 02 44527 | | 6/2002 | |
| WO | WO 03 023194 | | 3/2003 | |
| WO | WO 03/080999 | A1 | 10/2003 | |
| WO | WO 2005040560 | A1 * | 5/2005 | |
| WO | WO 2005059317 | A1 * | 6/2005 | |

* cited by examiner

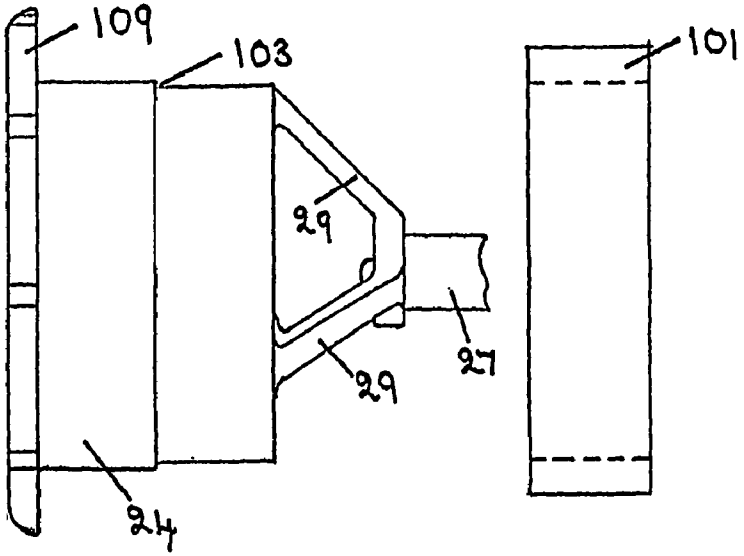
FIG 10
FIG 8
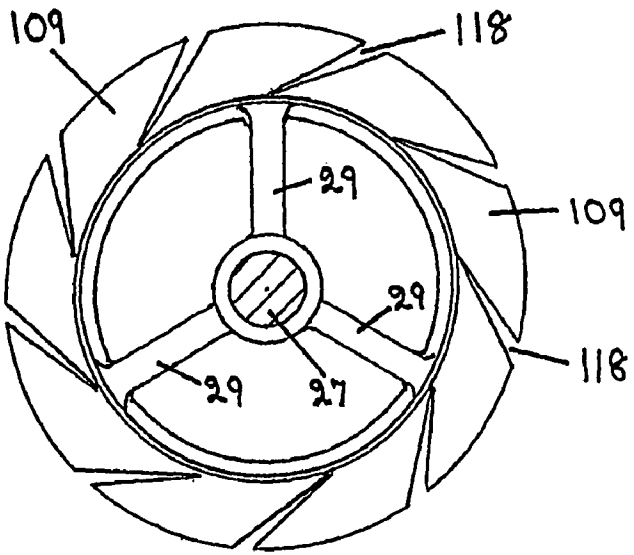
FIG 9

VARIABLE TURBOCHARGER APPARATUS WITH BYPASS

BACKGROUND OF THE INVENTION

This invention relates to turbocharger apparatus and, more especially, this invention relates to variable turbocharger apparatus.

Variable turbocharger apparatus is known comprising a housing, a compressor mounted for rotation in the housing, a turbine mounted for rotation in the housing, a first inlet for enabling air to be conducted to the compressor, an outlet for enabling air from the compressor to be conducted to an engine, a second inlet for enabling exhaust gases from the engine to be conducted to the turbine in order to rotate the turbine, a chamber which extends around the turbine and which receives the exhaust gases from the second inlet before the exhaust gases are conducted to the turbine, a bearing assembly for permitting the rotation of the turbine, a heat shield for shielding the bearing assembly from the exhaust gases, and a control system to control the speed of the turbine. One of the problems with such known variable turbocharger apparatus is the overall range limit, whereby if all of the gases are passed through the turbine, and if the variable turbocharger apparatus is designed to operate over a large flow volume, there is a point where the low down efficiency of the variable turbocharger apparatus starts to depreciate.

BRIEF SUMMARY OF THE INVENTION

It is an aim of the present invention to obviate or reduce the above mentioned problems.

Accordingly, the present invention provides variable turbocharger apparatus comprising a housing, a compressor mounted for rotation in the housing, a turbine mounted for rotation in the housing, a first inlet for enabling air to be conducted to the compressor, an outlet for enabling air from the compressor to be conducted to an engine, a second inlet for enabling exhaust gases from the engine to be conducted to the turbine in order to rotate the turbine, a chamber which extends around the turbine and which receives the exhaust gases from the second inlet before the exhaust gases are conducted to the turbine, and a bearing assembly for permitting the rotation of the turbine, the variable turbocharger apparatus comprising vanes which are mounted in the chamber and which are for accurately directing exhaust gases on to the turbine, a piston which is slidable and which is positioned between the housing and the turbine, and control means which is connected to the piston and which is for—controlling the sliding movement of the piston, the piston having an end which is nearest the bearing assembly and which defines a gap, the size of the gap being variable in dependence upon the sliding of the piston under the control of the control means, the size of the gap being effective to control the amount of the exhaust gases that act on the turbine thereby accurately controlling the speed of rotation of the turbine and thereby the amount of air conducted by the compressor through the outlet to the engine, and the variable turbocharger apparatus having at least one bypass aperture which is closed when the size of the gap is at a minimum and which opens when the gap reaches a predetermined size, the opening of the bypass aperture being such as to allow exhaust gases that are not required for acting on the turbine to bypass the turbine and the sliding of the piston being such that the piston is always maintained in a position which enables the turbine speed to be controlled through the gap alone when there is no bypass and through the gap and the bypass aperture when there is bypass.

The variable turbocharger apparatus of the present invention is able to operate over a larger operating range, and allows for better low down efficiency of the variable turbocharger apparatus because a smaller flow area turbine housing may be used. Also the gases are able to be guided accurately on to the turbine, even when gases are being bypassed. This design allows for a larger operating range of the variable turbocharger apparatus and a high operating efficiency.

The variable turbocharger apparatus of the present invention may be such that the end of the piston has a flange which extends radially outwardly. The flange may have slots for receiving the vanes. The slots may be open slots which extend inwardly from the periphery of the flange, or closed slots in the flange. With the slots, the flange on the end of the piston then forms a control ring that operates over the vanes.

The variable turbocharger apparatus may be one in which the flange is such as to allow gases to bypass a back face of the flange whilst still allowing accurate gas flow onto the turbine.

By using the flange, the exhaust gases are able to be guided more accurately through the vanes onto the turbine. Thus the flange enables the performance of the variable turbocharger apparatus to be enhanced. The flange also allows gases to bypass the back face of the flange, so gases may enter into the bypass system. It should be noted that when gases are being bypassed, the flange allows the gases to be accurately guided onto the turbine, so the flow to the turbine is always operating at high efficiency. Pressure on the back face of the flange helps to keep the piston in a closed position, so that a smaller sized control means may be used. When the flange has the slots, gas leakage through the slots where the vanes are located is not a problem with the variable turbocharger apparatus of the present invention because gas pressure is the same both sides of the flange. During use of the variable turbocharger apparatus, if a carbon deposit builds up on the vanes, then this is cleaned off as the flange of the piston moves backwards and forwards over the vanes. Gas leakage is prevented when the piston is in its closed position. When the piston is in its closed position, this is the most vulnerable time for gas leakage. However, with the variable turbocharger apparatus of the present invention, all the gases are guided accurately through the vanes and the flange as required.

The variable turbocharger apparatus may include a heat shield for shielding the bearing assembly from heat from the exhaust gases. The heat shield may be a ring-shaped heat shield. Alternatively, the heat shield may be a disc-shaped heat shield having an outer ring portion, an inner wall portion, and an aperture through the inner wall portion. The heat shield may also be of a design so to allow the heat shield to float and be held in position by spring means in order to prevent gas leakage. This design also allows for an air cooling system to be used behind the heat shield.

The vanes may be mounted on the heat shield.

The variable turbocharger apparatus may be one in which the slots are of a V-shape in order that gases are able to bypass in a controlled manner in order to prevent turbine surging.

The variable turbocharger apparatus of the present invention may be one in which the bypass aperture is in an insert Usually, there will be a plurality of the bypass apertures. The vanes may be mounted on the insert. When the variable turbocharger apparatus includes the insert, then the flange may or may not be present as may be desired.

The insert may be a removable insert which is removable from the housing, the removable insert being such that it facilitates assembly of the variable turbocharger apparatus. The removable insert may be a sliding insert.

The removable insert may be held in position by spring means. The spring means may be such that it forms a seal for preventing gas leakage from the chamber which surrounds the turbine. The spring means may be advantageous for manufacture and assembly of the variable turbocharger apparatus in that it reduces tolerance requirements. The spring means may be formed as a heat shield. Alternatively, the spring means may be formed as a disc-shaped spring.

If desired, the insert may be a non-removable insert which is not removable from the housing.

The variable turbocharger apparatus may be one in which the piston passes through a bore in the insert.

Advantageously, the piston has a first abutment for forming a seal against a mating surface thereby to prevent loss of the exhaust gases between the abutment and the mating surface. The mating surface may be a mating surface on a part of the housing. Alternatively, the mating surface may be a mating surface on the insert The mating surface may also be used to set the start gap of the turbocharger apparatus.

The variable turbocharger apparatus may be one in which the piston has a second abutment for engaging against the end of the vanes, thereby setting the gap when the piston is in its closed position.

The variable turbocharger apparatus may include a sealing ring for forming an auxiliary seal for preventing loss of any of the exhaust gases that pass between the first abutment and the mating surface.

The variable turbocharger apparatus may be one which includes a ring on the piston for setting the size of the gap at a start condition, the ring also being such that it acts as an abutment for preventing gas leakage.

The control means may include a fork member which is connected to the piston on two opposed sides. Alternatively, the control means may include a U-shaped member which is connected to the piston on a face of the piston.

The control means will be an electronic control means which operates as part of an engine management control system. The control system may also use an air or oil operated actuator control means in conjunction with the engine management system.

The variable turbocharger may be one in which the chamber is a volute. Various types of chamber may be employed, for example of various cross sectional shapes.

BRIEF DESCRIPTION OF THE SEVERAL VIEWS OF THE DRAWINGS

Embodiments of the invention will now be described solely by way of example and with reference to the accompanying drawings in which:

FIGS. 8 and 9 are side and end views of a piston with a flange and slots in the flange;

FIG. 10 is a side view of a ring member for going over the right hand end of the piston as shown in FIG. 8;

DETAILED DESCRIPTION OF THE INVENTION

Figure 1:
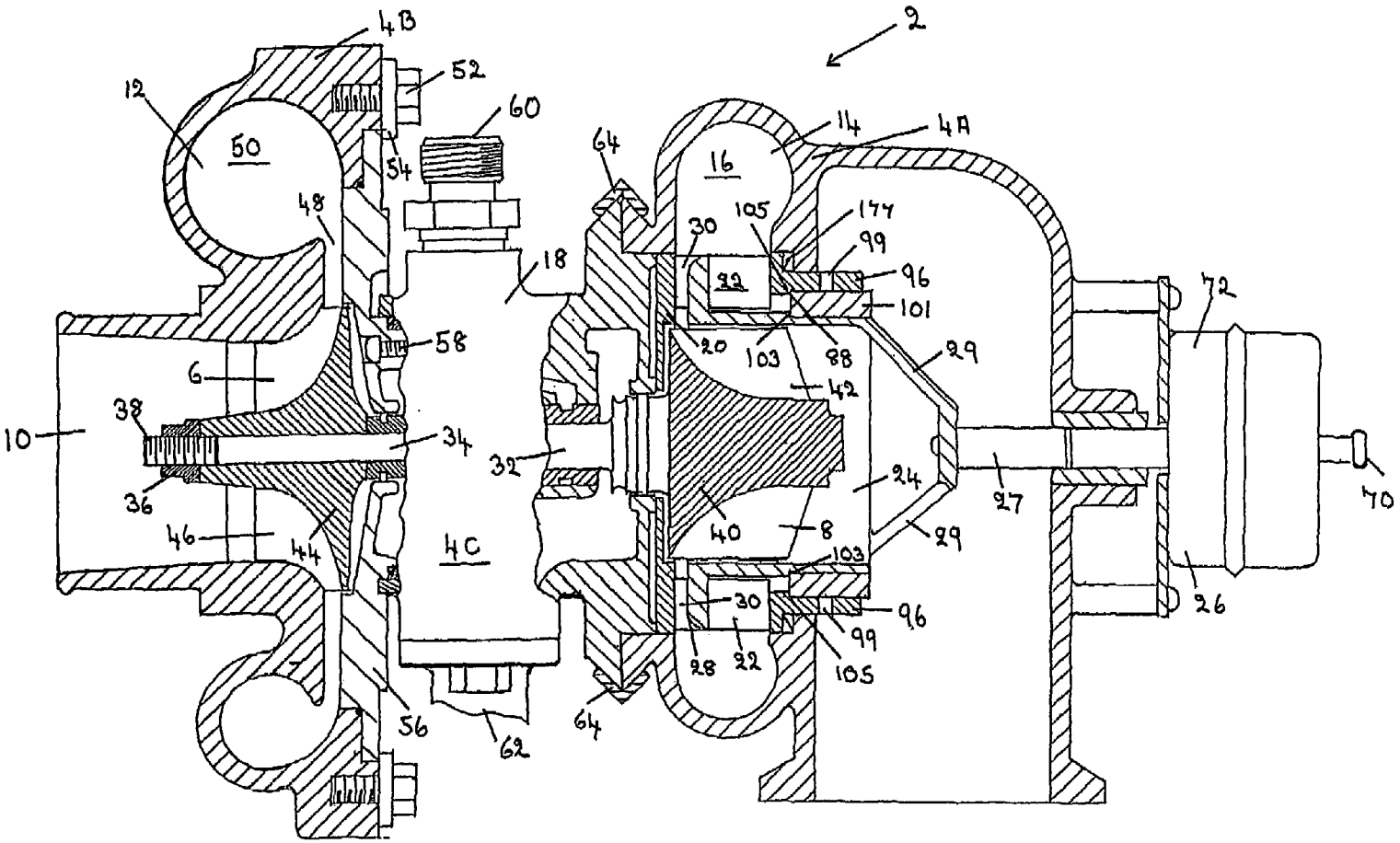
FIG. 1 is a section through first variable turbocharger apparatus with a piston in a closed position.

Referring to FIGS. 1-4, there is shown variable turbocharger apparatus 2 comprising a housing 4 a compressor 6 mounted for rotation in the housing 4, and a turbine 8 which is also mounted for rotation in the housing 4. The variable turbocharger apparatus 2 also comprises a first inlet 10 for enabling air to be conducted to the compressor 6, and an outlet 12 for enabling air from the compressor 6 to be conducted to an engine (not shown).

The variable turbocharger apparatus 2 has a second inlet 14 for enabling exhaust gases from the engine to be conducted to the turbine 8 in order to rotate the turbine 8. A chamber 16 extends around the turbine 8 and receives the exhaust gases from the second inlet 14 before the exhaust gases are conducted to the turbine 8.

A bearing assembly 18 permits the rotation of the turbine 8. A heat shield 20 is provided for shielding the bearing assembly 18 from heat from the exhaust gases.

The variable turbocharger apparatus 2 comprises vanes 22 which are mounted in the chamber 16 and which are for accurately directing the exhaust gases on to the turbine 8. A piston 24 is positioned between the vanes 22 and the turbine 8. The piston 24 is a slideable piston. Control means 26 control the sliding movement of the piston 24.

The piston 24 has an end 28 which is adjacent the heat shield 20. This end 28 is spaced apart from the heat shield by a gap 30. FIG. 1 shows the piston 24 in a closed position in which the gap 30 is at its smallest condition. The size of the gap 30 is variable in dependence upon the sliding of the piston 24, as can be appreciated from FIGS. 2, 3 and 4. The sliding of the piston 24 is under the general control of the control means 26. The size of the gap 30 is effective to control the amount of the exhaust gases that acts on the turbine 8, thereby accurately controlling the rotational speed of the turbine 8 and thereby the amount of air conducted by the compressor through the outlet 12 to the engine.

The variable turbocharger apparatus 2 also comprises a shaft 32 on which the turbine 8 and the compressor 6 are mounted. The compressor 6 is secured to a reduced diameter end portion 34 of the shaft 32 by a nut 36 which screws on to a screw threaded portion 38 on the end portion 34 of the shaft 32.

The turbine 8 has a central body portion 40 and vanes 42. The compressor 6 has a central body portion 44 and vanes 46.

Compressed air from the compressor 6 passes along a diffuser passage 48 into a chamber 50 in the form of a volute as shown. The chamber 16 feeding the exhaust gases to the turbine 8 is also in the form of a volute as shown.

Bolts 52 bearing on washers 54 secure a back plate 56 to a part of the housing 4 that is for the compressor 6. Bolts 58 go into the bearing assembly 18 to hold the back plate 56 in position.

The bearing assembly 18 has an oil intake 60 for providing oil for the bearing assembly 18. Also provided is an oil drain 62.

Clamp 64 acts on the housing 4 and the bearing assembly 18 to clamp the bearing assembly 18 to the part of the housing 4 that is for the turbine 8.

The piston 24 slides against an insert 96 as shown. The insert can be made of a corrosion resistant material depending upon the material used for the housing 4. The housing 4 can basically be regarded as being a three part housing comprising a turbine housing 4A, a compressor housing 4B, and a bearing housing 4C.

Referring to FIGS. 1-4, the control means 26 has an air intake 70 for controlling an actuator member 72. A diaphragm (not shown) in the actuator member 72 is acted upon by air or a vacuum. The air intake or vacuum is controlled by an electronic control device (not shown). Movement of the diaphragm causes movement of rod 27, and movement of piston 24 that is connected to the rod 27 by arms 29 of the piston 24.

Figure 19:
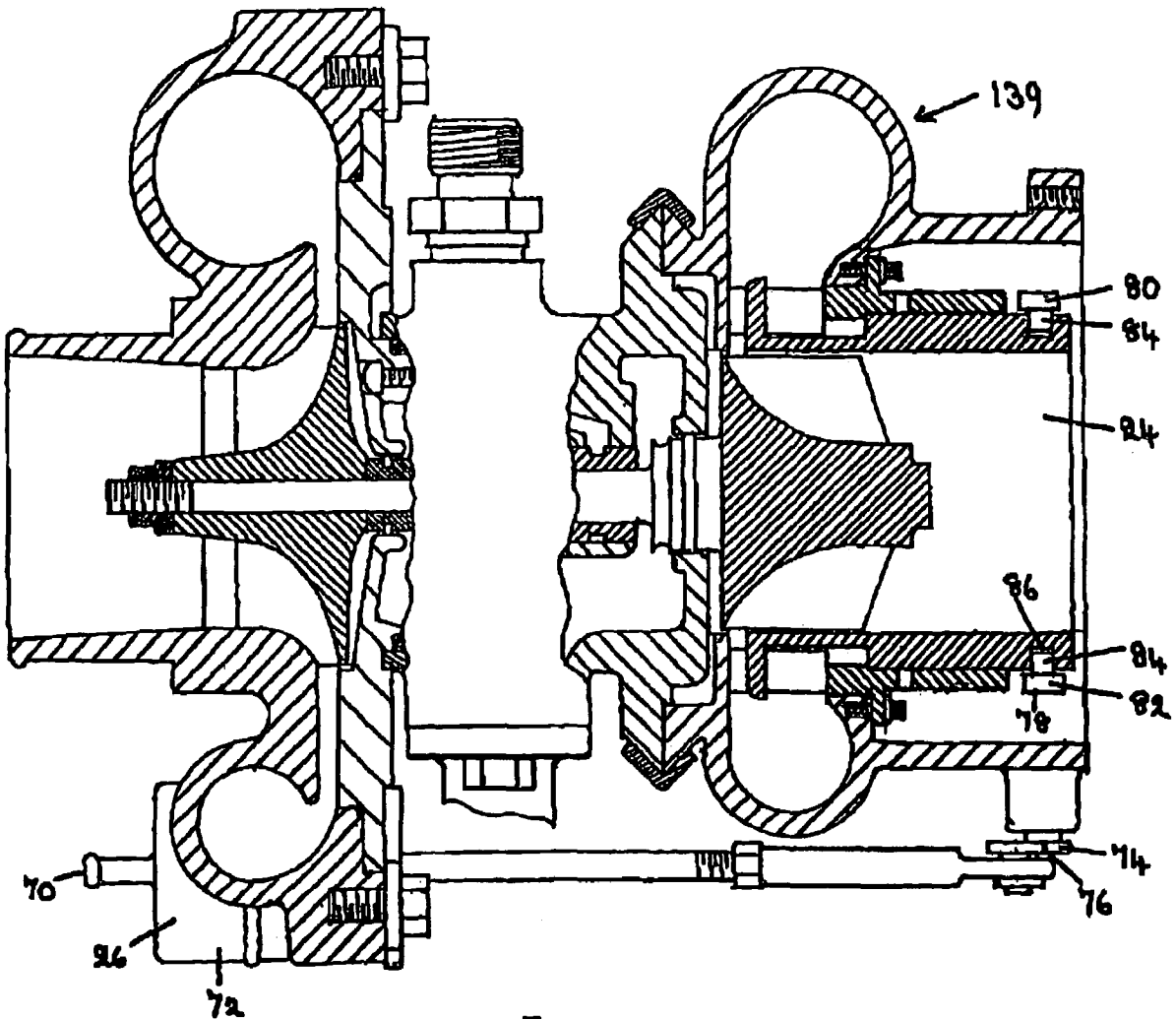
FIG. 19 is a side section through seventh variable turbocharger apparatus of the present invention.
Figure 20:
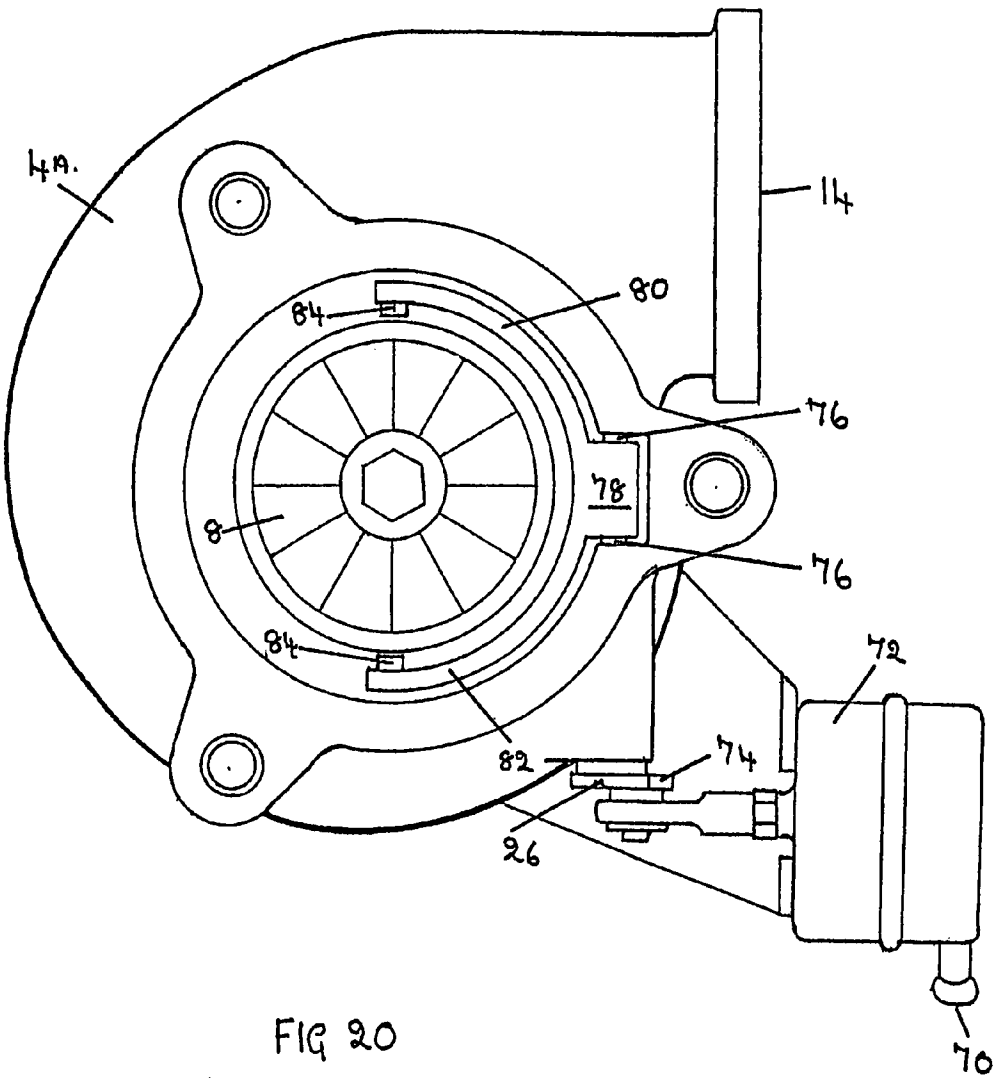
FIG. 20 is a side of variable turbocharger apparatus of the present invention and shows control means.

An alternative control means is shown in FIGS. 19 and 20. The control means 26 has an air intake 70 for controlling an actuator 72. A diaphragm (not shown) in the actuator member 72 is acted upon by air or a vacuum. The air intake is controlled by an electronic control device (not shown). Movement of the diaphragm causes movement of an arm 74. The arm 74 pivots a rod 76 (see FIG. 20). The rod 76 as best shown in FIG. 20, is connected to a fork device 78 having a pair of arms 80, 82. Each arm 80, 82 has a locator member 84. Each location member 84 locates in a recess 86 as shown in FIG. 19.

As can be seen from FIGS. 1-4, the vanes 22 are mounted on the insert 96. In an alternative embodiment of the invention, the vanes 22 may be mounted on the heat shield 20.

The piston 24 has an abutment 88 for forming a seal against a mating abutment 105, thereby to prevent loss of the exhaust gases between the abutment 88 and the abutment 105. The abutment 105 is formed as a part of the insert 96.

Figure 14:
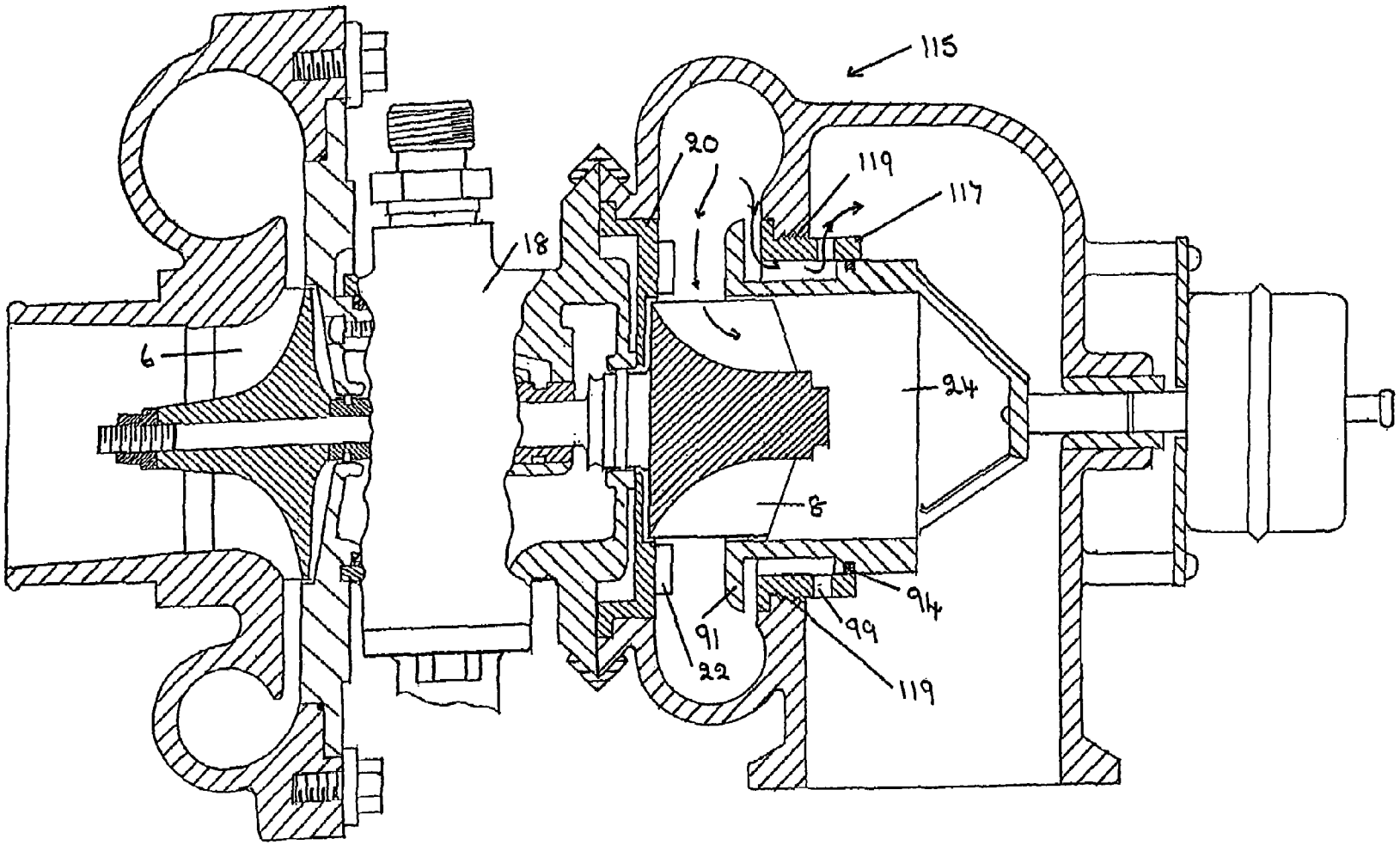
FIG. 14 is a section through second variable turbocharger apparatus of the present invention.

The provision of the abutment 88 and the mating surface 105 may be sufficient to prevent the loss of the exhaust gases between the abutment 88 and the mating surface 105. As an extra precaution against the loss of the exhaust gases, a seal 94 is provided. In FIG. 14, the seal 94 is provided in a piston 24 in a part of the housing 4. The seal 94 is in the form of a sealing ring and it thus acts to form an auxiliary seal for preventing loss of any of the exhaust gases that might pass between the abutment 88 and the mating surface 105.

The end 28 of the piston 24 has a flange 109. The flange 109 extends radially outwardly as shown. The flange 109 is provided with slots (not shown in FIG. 1) for receiving the vanes 22.

The heat shield 20 shown in FIG. 1 is a disc-shaped heat shield which is of a floating type of design, and which has an outer ring portion 93 and an inner wall portion 95. The inner wall portion 95 has an aperture 97 through which the turbine 8 passes.

Figure 21:
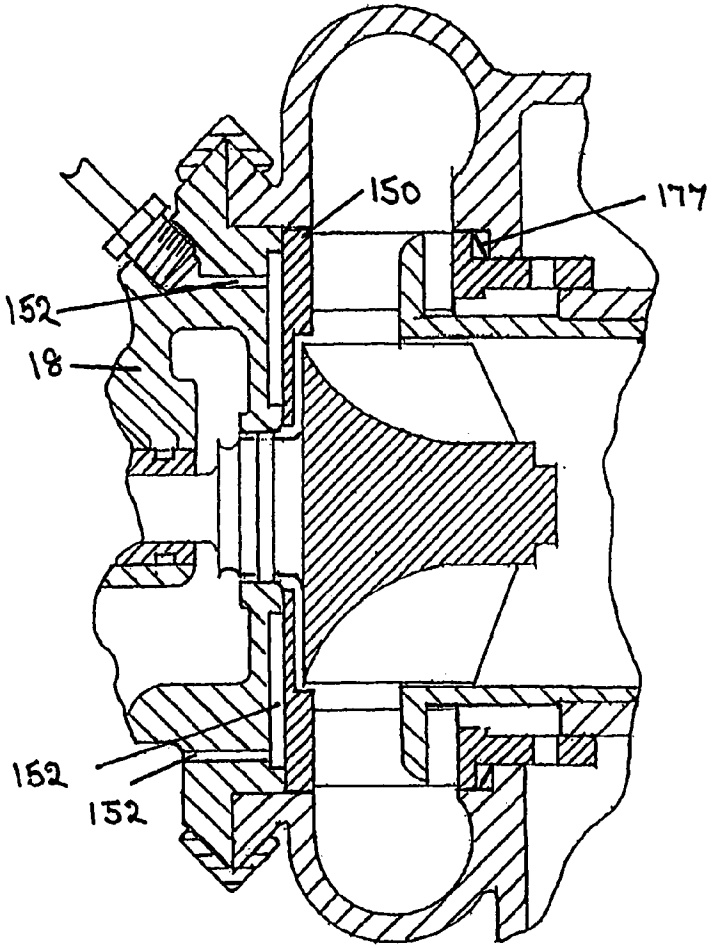
FIG. 21 is a section through part of eighth variable turbocharger apparatus of the invention.

FIG. 1 shows the heat shield pushed against the bearing assembly 18, in order to seal the back face of the heat shield so that an air cooling system may be used, or to seal between the heat shield and bearing assembly as shown in FIG. 21.

FIG. 1 shows the variable turbocharger apparatus 2 with the gap 30 at a minimum. In this position, bypass apertures 99 in the insert 96 are closed by a ring member 101 which is secured over the piston 24 as shown such that it abuts against an abutment 103 and becomes part of piston 24. The ring member 101 abuts against an abutment 105 on the insert 96. This effectively limits the movement of the piston 24 to the left as shown in FIG. 1 and thus sets the minimum size of the gap 30.

Figure 2:
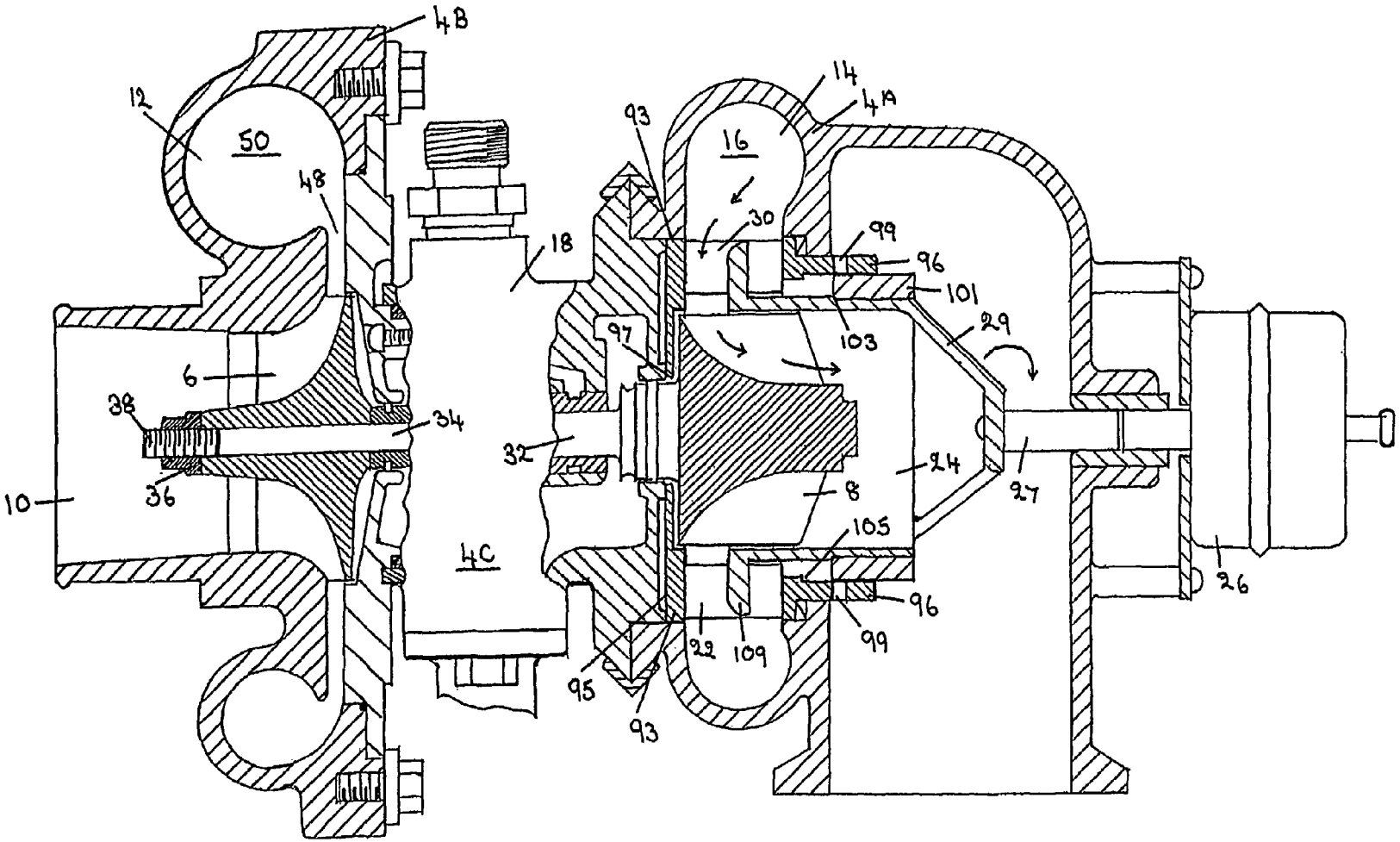
FIG. 2 is a section like FIG. 1 but with a piston in a position just before the gases are allowed to bypass.

FIG. 2 shows the piston 24 having moved towards the right as shown in FIG. 2 in order to increase the size of the gap 30. In the position of the piston 24 shown in FIG. 2, the bypass apertures 99 are still closed by the ring member 101.

Figure 3:
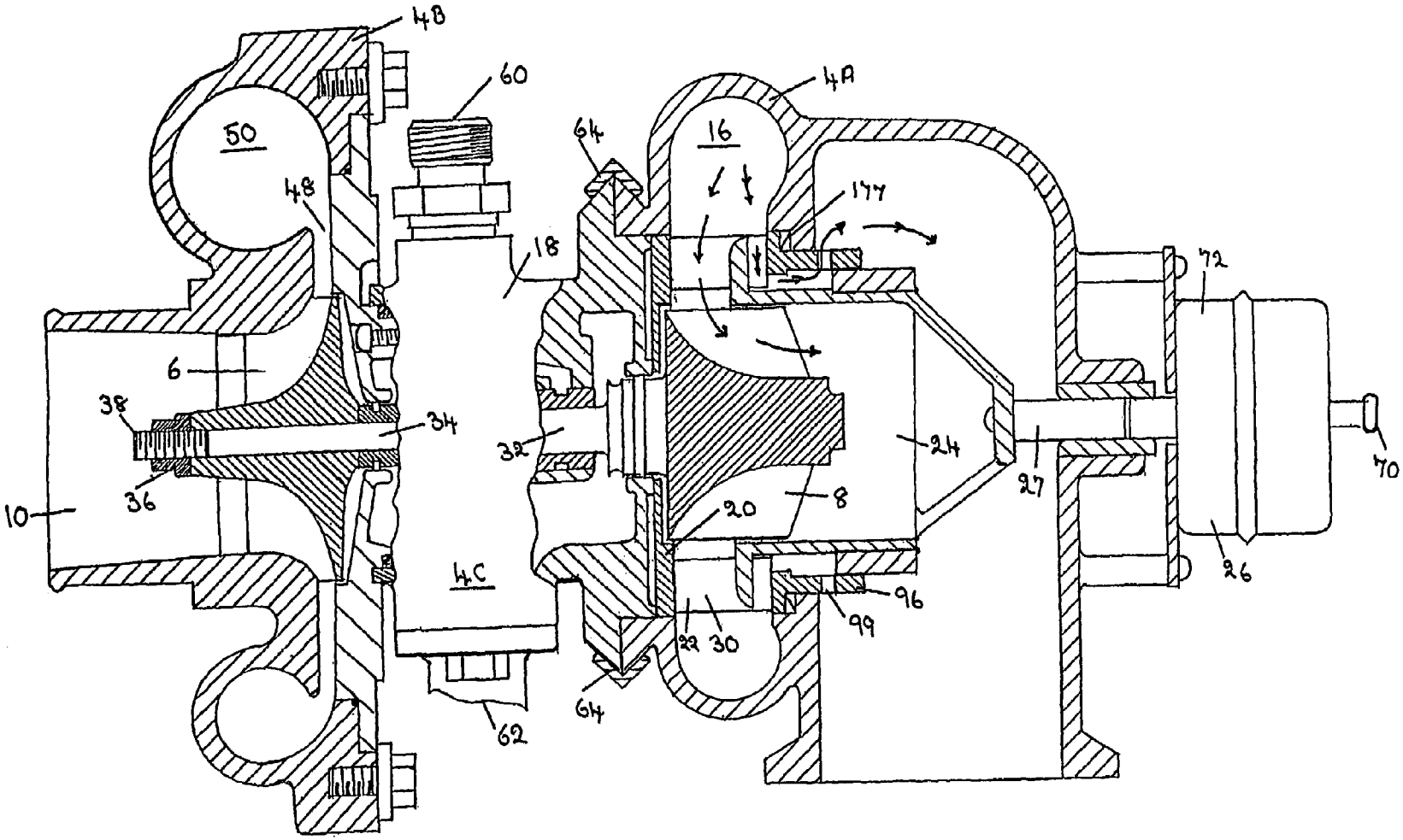
FIG. 3 is a section like FIG. 1 but with a piston in a fully open bypass position.
Figure 4:
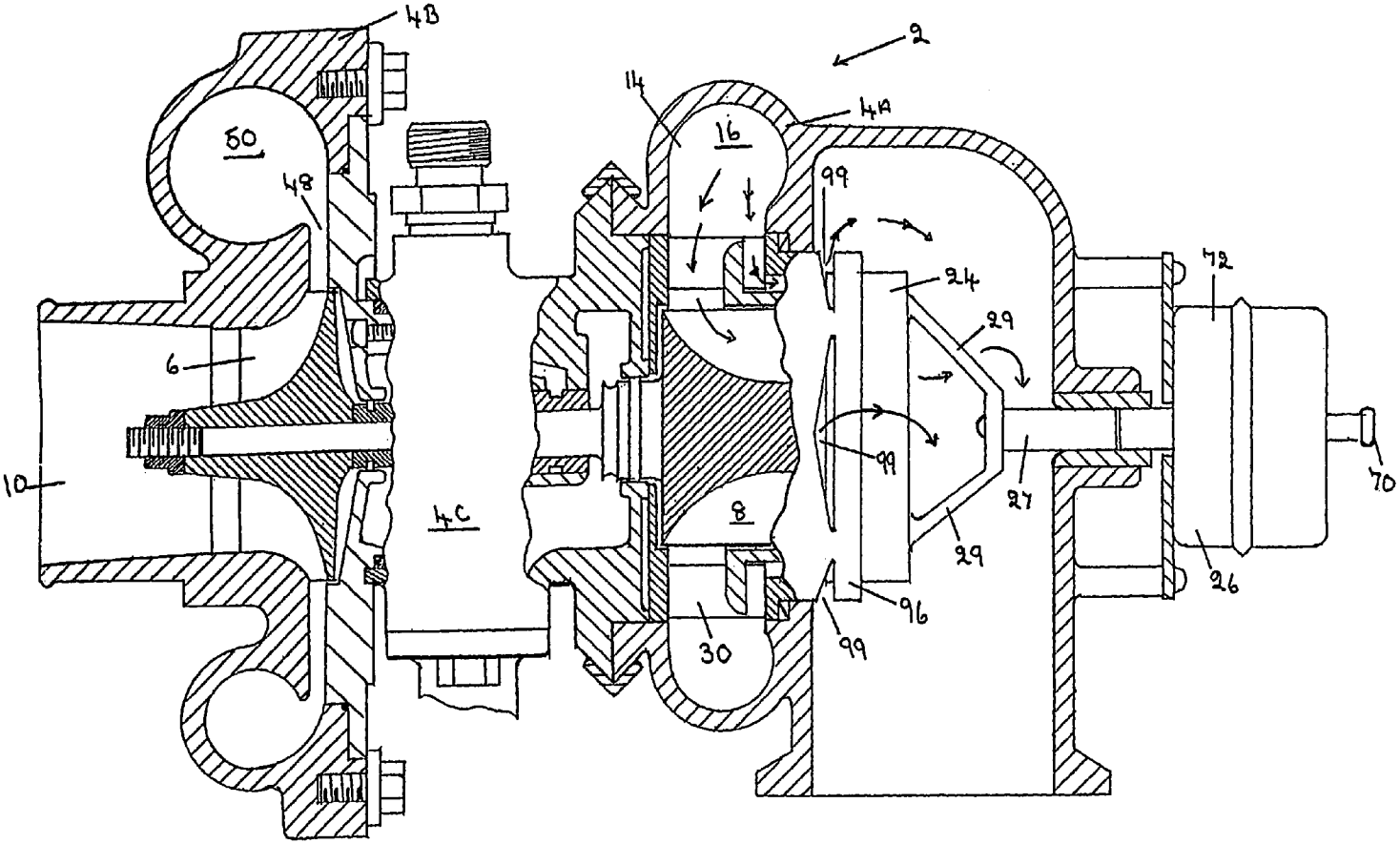
FIG. 4 is a section like FIG. 3 but shows bypass apertures in side view rather than in section.

FIG. 3 shows the piston 24 having moved further still to the right as shown in FIG. 2. In the position of the piston 24 shown in FIG. 3, the bypass apertures 99 have been uncovered by the ring member 101. FIG. 4 shows the bypass apertures 99 from the outside rather than in cross section as in FIG. 3. During operation of the turbocharger apparatus 2, the bypass apertures 99 open when the gap 30 reaches a predetermined size. The opening of the bypass apertures 99 is such as to allow exhaust gases that are not required for acting on the turbine 8 to bypass the turbine 8. In FIGS. 1-4, the gases that act on the turbine 8 are shown by directional lines having a single arrowhead. In FIGS. 3 and 4, the gases that bypass the turbine 8 are shown by directional arrows with two arrowheads. As can be seen from FIGS. 3 and 4, the exhaust gases in the chamber 16 around the turbine 8 flow in two directions at the same time. Thus exhaust gases are able to act at the required pressure on the turbine 8, and exhaust gases that are not required are able to bypass the turbine 8. This avoids the situation where otherwise, all the gases in the chamber 16 would act on the turbine 8 at too greater pressure and would cause the turbine 8 to revolve too fast and destroy the turbocharger apparatus 2 when a smaller turbine housing was used to improve low down response. The use of the bypass apertures 99 also avoids the alternative which is currently employed of having two separate exhaust gas control systems, one being for controlling the gases onto the turbine, and the other being for controlling the gases through a waste gate system when the pressure is too high. Self-evidently, two separate control systems double costs, in addition to providing more components for potential wear and failure.

Figure 7:
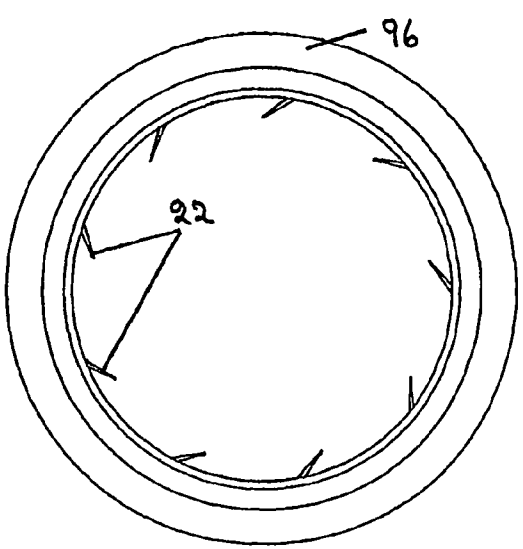
FIGS. 5, 6 and 7 show side and end views of an insert having bypass apertures and vanes, and a bypass area in a bore of the insert.
Figure 5:
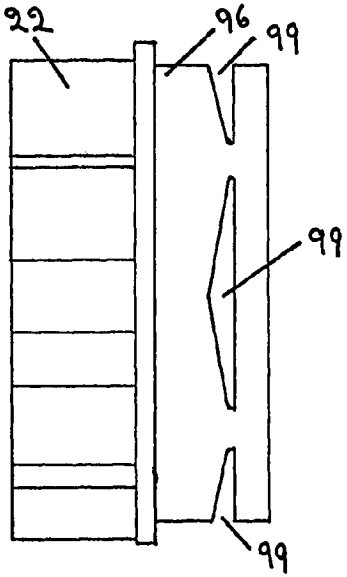
Figure 6:
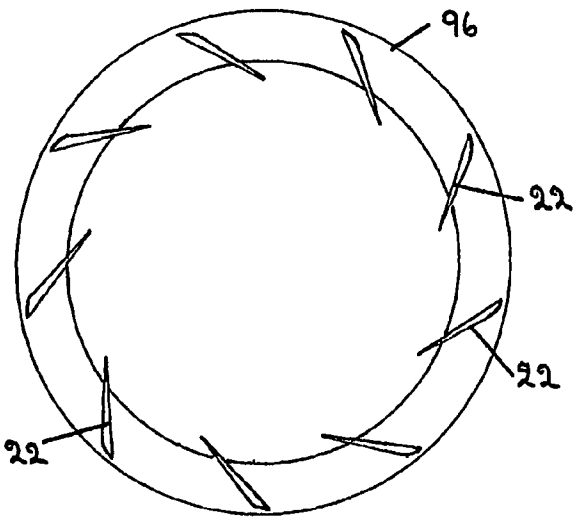

FIGS. 5, 6 and 7 show the insert 96. In particular, FIGS. 5, 6 and 7 show the position of the vanes 22 on the insert 96, and also the shape of the bypass apertures 99. The bypass apertures 99 are triangularly shaped as shown. The bypass apertures are progressively opened to increase their volume. This provides a controlled opening of the bypass apertures 99 and avoids fluctuations in operation of the turbocharger apparatus 2 which might otherwise occur due to a too sudden opening of the bypass apertures 99 and a consequent too sudden loss of exhaust gas pressure in the chamber 16.

FIGS. 8, 9 and 10 illustrate how the piston 24 is provided with three arms 29 for connecting the piston 24 to a shaft 27 which connects to an actuator member 72 forming part of control means for the variable turbocharger apparatus 2.

Figure 11:
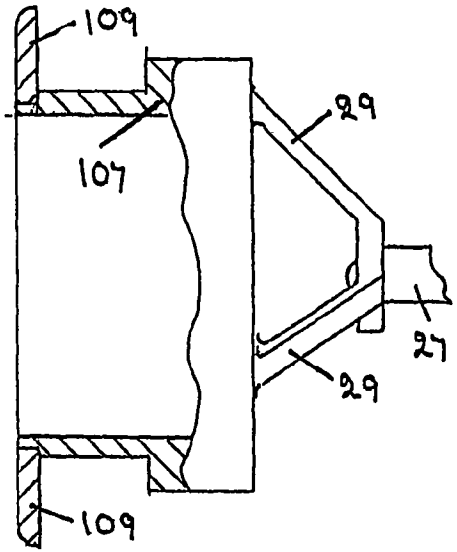
FIG. 11 is a side view of a piston and shows the mounting of a flange on the end of the piston.
Figure 12:
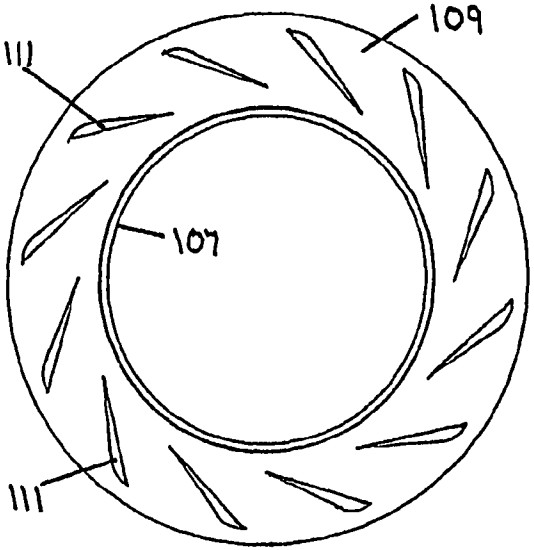
FIG. 12 is an end view of a flange part of the piston shown in FIG. 11, the flange having slots for vanes.

FIGS. 11 and 12 show a piston 107 having a flange 109. Slots 11 are provided in the flange 109 and the slots 111 are closed ended slots. Also shown in FIG. 11 is how the flange 109 may be fixed to the end of the piston 107.

Figure 13:
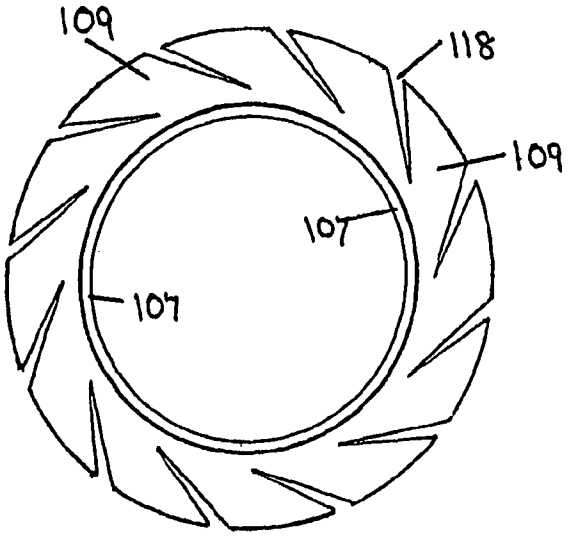
FIG. 13 is an end view of a flange part of the piston shown in FIG. 11, flange being an alternative to that shown in FIG. 12 and the flange having slots extending inwardly from a periphery of the flange.

FIG. 13 shows the flange 109 provided with alternative slots 118 which are open at the periphery of the flange 109 as shown in FIG. 13.

FIG. 14 shows second variable turbocharger apparatus 115 which is like the variable turbocharger apparatus 2 but which has an insert 117 which screws into a part of the housing 4 by screw threads 119. In FIG. 14, the vanes 22 are short vanes and they are mounted on the heat shield 20. The flange 91 of the piston 24 does not have any slots for the vanes.

Figure 15:
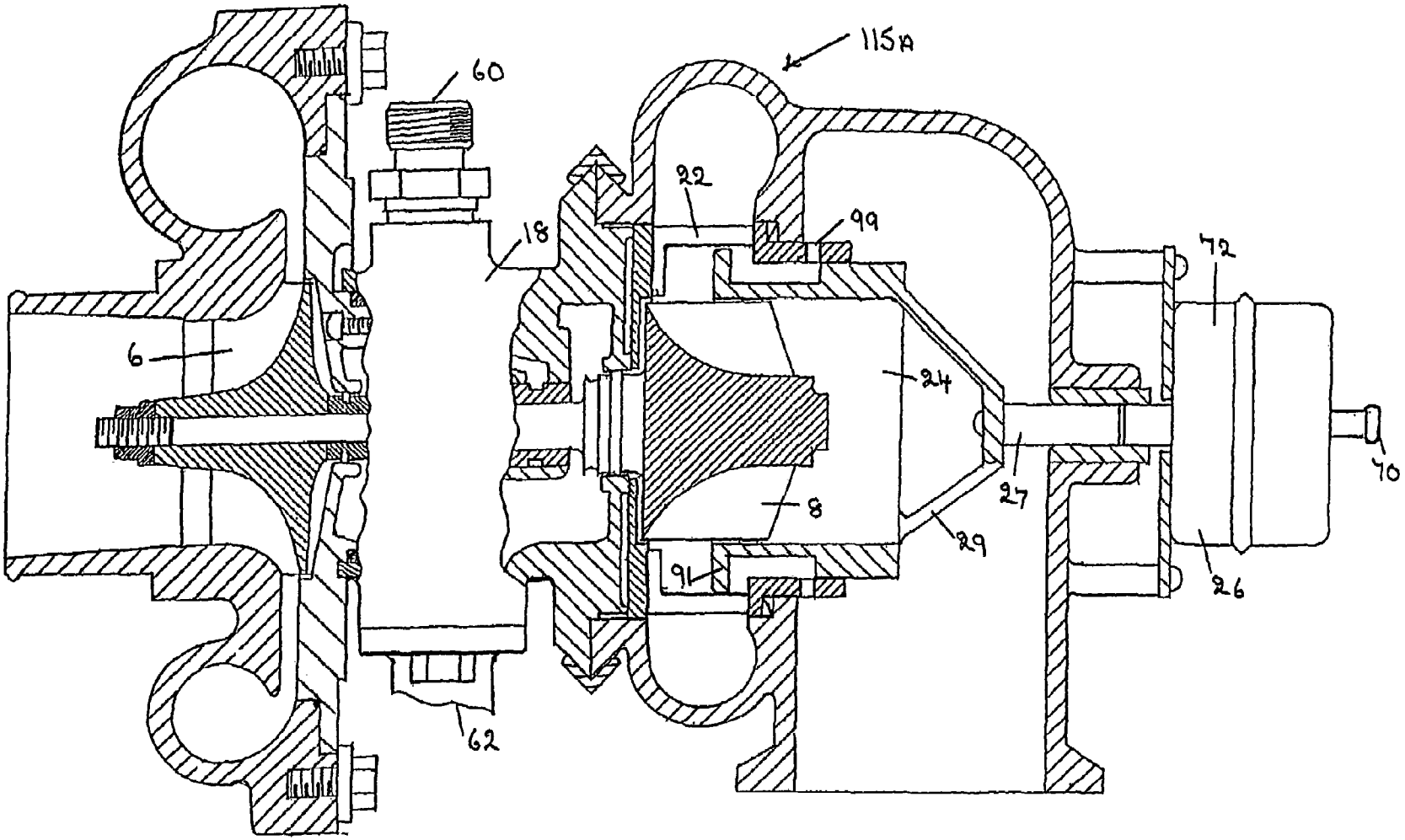
FIG. 15 is a section through part of the third variable turbocharger apparatus of the invention.

FIG. 15 is a section through part of third variable turbocharger apparatus 115A and shows vanes going across a volute entry passage. The vanes do not go through slots in the flange.

Figure 16:
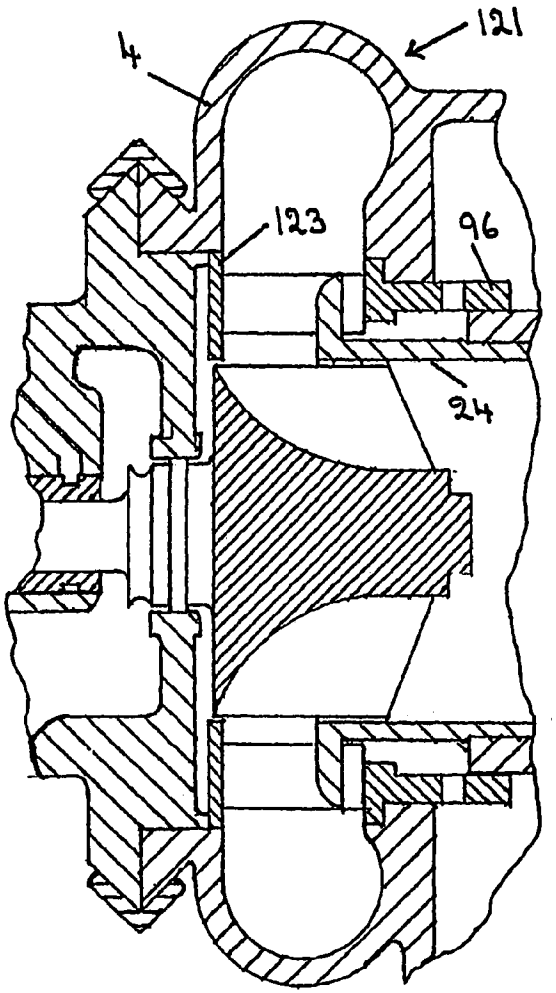
FIG. 16 is a section through part of fourth variable turbocharger apparatus of the present invention.

FIG. 16 shows part of fourth variable turbocharger apparatus 121 in which a disc spring 123 is used to push the insert 96 to the right as shown in FIG. 16 in order to seal the insert 96 in the turbine housing 4. The disc spring 123 is also able to be used as a heat shield.

Figure 17:
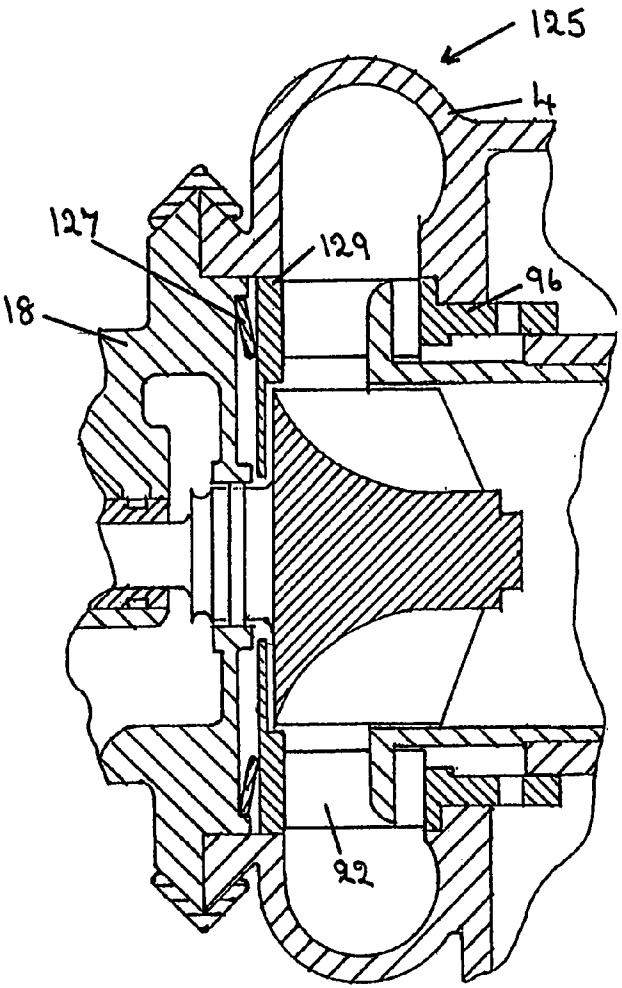
FIG. 17 is a section through part of fifth variable turbocharger apparatus of the present invention.

FIG. 17 shows part of variable turbocharger apparatus 125 utilising a disc spring 127 and a heat shield 129. The heat shield 129 is pushed over by the disc spring 127. The heat shield 129 pushes the vanes 22 over to seal in the insert 96 in the housing 4, and also to prevent rotation of the insert 96. With the disc spring 127 between the heat shield 129 and the bearing housing 18, the disc spring 127 may be used to seal the back of the heat shield 129, and the heat shield 129 helps to prevent heat adversely affecting the disc spring 127. The turbocharger 125 as shown in FIG. 17 is of a design that also allows for a good flow of the exhaust gases, because the heat shield 129 is flush against ends of the vanes 22.

Figure 18:
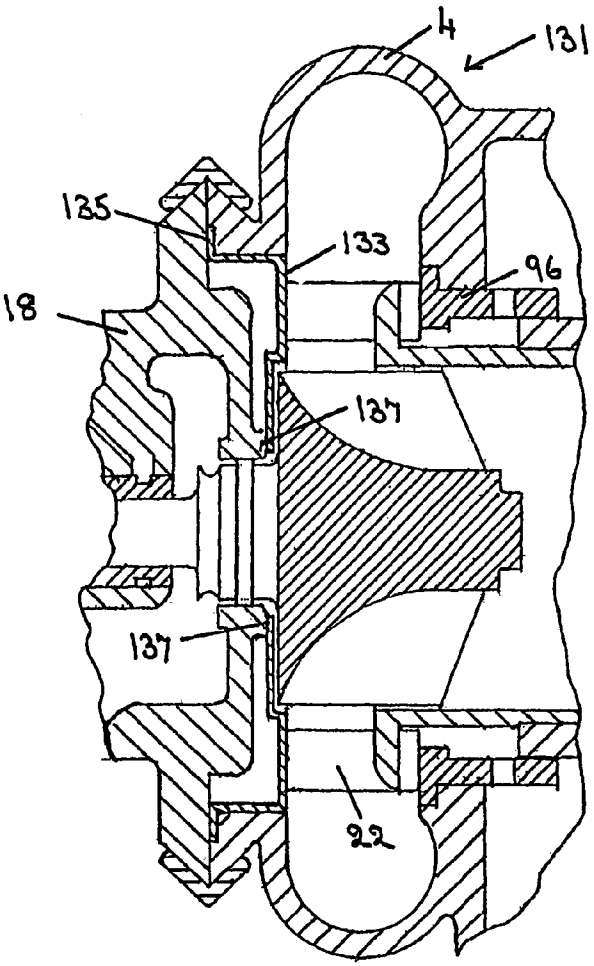
FIG. 18 is a section through part of sixth variable turbocharger apparatus of the present invention.

FIG. 18 shows part of variable turbocharger apparatus 131 in which a heat shield 133 is used as a spring to push the insert 96 to the right as shown in FIG. 18 in order to seal in the turbine housing 4. The heat shield 133 is fixed at its outer periphery 135 as shown, and at its inner periphery 137 as shown. The inner periphery 137 of the heat shield 133 forms an inner ring that may be used to seat against the bearing housing as shown in FIG. 18, in order to push the heat shield 133 over against the vanes 22.

FIG. 19 is a section through seventh variable turbocharger apparatus 139. FIG. 19 shows a control system using a fork to move and control the movement of the piston 24.

FIG. 20 shows an end view of the turbocharger apparatus of the present invention, for example as shown in FIG. 19, and illustrates in more detail the location of the fork member 78.

FIG. 21 shows variable turbocharger apparatus having a floating heat shield 150 that seals under spring pressure from a spring 177. Also shown in FIG. 21 is a cooling system 152 which is formed between the heat shield 150 and the bearing housing 18.

The variable turbocharger apparatus of the present invention and shown in the accompanying drawings is able to work efficiently and to be manufactured economically. The gap 30 is able to be varied by the sliding piston 24. Where a flange on the end of the piston is employed, then the flange forms a control ring that slides over the vanes. By using the flange, the exhaust gases are guided more accurately through the vanes onto the turbine. Thus, the performance of the variable turbocharger apparatus is enhanced. Pressure on the back face of the flange helps to keep the piston in a closed position, so that a smaller sized control means may be used. Gas leakage through the slots where the vanes are located is not a problem with the variable turbocharger apparatus of the present invention because gas pressure is the same both sides of the control ring. During use of the variable turbocharger apparatus, if a carbon deposit builds up on the vanes, then this is cleaned off as the flange of the piston moves backwards and forwards over the vanes, with the vanes passing through the slots in the flange. Gas leakage is prevented when the piston is in its closed position. When the piston is in its closed position, this is the most vulnerable time for gas leakage. However, with the variable turbocharger apparatus of the present invention, all the gases are guided accurately through the vanes, the heat shield and the flange in order to work on the turbine as required.

With the turbocharger apparatus of the present invention, the turbocharger apparatus is able to allow a smaller volume turbine housing to be used. This in turn gives a better low down response of the turbine.

The turbocharger apparatus of the present invention is able to guide the gases onto the turbine through the vanes on the insert, and the flange on the piston, this gives good performance of the turbine.

The insert may be held in place by a spring in order to seal the insert from gas leakage. The spring also prevents rotation of the vanes and the insert This is also a quick and cheap form of production. With this design, the vanes may be pushed against the heat shield to give a good gas flow.

The bypass apertures in the insert allow the gases to bypass the turbine in order to lower the pressure in the volute area of the turbine housing when the gap opens past a predetermined position. Any suitable and appropriate predetermined position may be utilised, depending upon the type of engine to which the turbocharger apparatus is fitted.

The control of the piston 24 to control the variable part of the turbocharger apparatus, and the bypass apertures all form one control unit. This gives lower manufacturing costs than having to use two separate control units.

The bypass apertures 99 are designed triangular as shown in order to prevent a large pressure drop when the system opens up the bypass apertures 99. This prevents turbine wheel surge as mentioned above. An alternative to the bypass apertures 99 being triangularly shaped as shown is to have the slots of any other suitable and appropriate formation, for example of a radius gap shape.

The flange 91 or 109 on the piston 24 allows the gases to be guided through the turbine to give good performance. The flange 91 or 109 also allows the gases to enter past the backface of the flange so as to allow the gases to enter into an area between the piston 24 and bore where the piston 24 works, so as to allow the gases to bypass through the bypass apertures 99.

When the piston 24 is in its closed position, the piston 24 may rest against the abutment 105 in the insert 96 as shown in FIG. 1, in order to prevent gas leakage and also to set the start gap of the piston 24. This design prevents all gas leakage when the piston is in its closed position. This is the most difficult part of a variable turbocharger in which to achieve good turbine performance. This is because the gas flow is at its lowest so that it is important to prevent gas leakage.

Sealing means may be used to prevent gas leakage when the variable part of the turbocharger apparatus is working if required. Different control systems for the piston may be used so that, for example, a fork system may be used.

A disc spring may be used to hold the insert 96 and to prevent gas leakage. The disc spring may also be used as a heat shield for the bearing assembly. The disc spring may be used so as to push a heat shield and thereby put pressure on the vanes of an insert in order to hold the insert in place and prevent gas leakage. The disc spring may also seal in order to prevent gas leakage between the heat shield and the bearing assembly. With this design, the vane ends are able to be held flush against the heat shield in order to give good gas flow to the turbine. Also, there are less hot gases working on the spring.

If desired, the insert 117 may be screwed into the turbine housing.

If desired, the disc spring 177 may be used to push the vanes of the insert 96 onto the heat shield, see FIG. 1. The disc spring 177 may be used as a seal to prevent gas leakage. This design pushes the vanes 22 flush against the heat shield 20. Also, a small disc spring may be used because the spring works with the spring in the actuator rather than against it.

It is to be appreciated that the embodiments of the invention described above with reference to the accompanying drawings have been given by way of example only and that modifications may be effected. Thus, for example, the shape of the chambers 16 and 50 may be varied. Also, the number of vanes may vary, and the sealing rings may be used or not used as may be desired. As can be seen from the drawings, the variable turbocharger apparatus of the invention is preferably one in which the piston slides between the vanes and the turbine.

The invention claimed is:

1. Variable turbocharger apparatus comprising a housing, a compressor mounted for rotation in the housing, a turbine mounted for rotation in the housing, a first inlet for enabling air to be conducted to the compressor, an outlet for enabling air from the compressor to be conducted to an engine, a second inlet for enabling exhaust gases from the engine to be conducted to the turbine in order to rotate the turbine, a chamber which extends around the turbine and which receives the exhaust gases from the second inlet before the exhaust gases are conducted to the turbine, and a bearing assembly for permitting the rotation of the turbine, the variable turbocharger apparatus comprising vanes which are mounted in the chamber and which are for accurately directing exhaust gases on to the turbine, a piston which is slidable and which is positioned between the housing and the turbine, and control means which is connected to the piston and which is for controlling the sliding movement of the piston, the piston having an end which is nearest the bearing assembly and which defines a gap, the size of the gap being variable in dependence upon the sliding of the piston under the control of the control means, the size of the gap being effective to control the amount of the exhaust gases that act on the turbine thereby accurately controlling the speed of rotation of the turbine and thereby the amount of air conducted by the compressor through the outlet to the engine, and the variable turbocharger apparatus having at least one bypass aperture which is closed when the size of the gap is at a minimum and which opens when the gap reaches a predetermined size, the opening of the bypass aperture allowing exhaust gases that are not required for acting on the turbine to bypass the turbine and the sliding of the piston being such that the piston is always maintained in a position which enables the turbine speed to be controlled through the gap alone when there is no bypass and through the gap and the bypass aperture when there is bypass.

2. Variable turbocharger apparatus according to claim 1 in which the end of the piston is such that it has a flange which extends radially outwardly.

3. Variable turbocharger apparatus according to claim 2 in which the flange has slots for receiving the vanes.

4. Variable turbocharger apparatus according to claim 3 in which the slots are open slots which extend inwardly from the periphery of the flange, or closed slots in the flange.

5. Variable turbocharger apparatus according to claim 2 in which the flange allows gases to bypass a back face of the flange whilst still allowing accurate gas flow onto the turbine.

6. Variable turbocharger apparatus according claim 1 and including a heat shield for shielding the bearing assembly from heat from the exhaust gases.

7. Variable turbocharger apparatus according to claim 6 in which the heat shield is selected from the group consisting of a ring-shaped heat shield, a disc-shaped heat shield having an outer ring portion, an inner wall portion, and an aperture through the inner wall portion; and a floating heat shield that is held in place under pressure by spring means.

8. Variable turbocharger apparatus according to claim 6 in which the vanes are mounted on the heat shield.

9. Variable turbocharger apparatus according to claim 1 in which the bypass aperture is of a V-shape in order that gases are able to bypass in a controlled manner in order to prevent turbine surging.

10. Variable turbocharger apparatus according to claim 1 in which the bypass aperture is in an insert.

11. Variable turbocharger apparatus according to claim 10 in which there is a plurality of the bypass apertures.

12. Variable turbocharger apparatus according to claim 10 in which the vanes are mounted on the insert.

13. Variable turbocharger apparatus according to claim 12 in which the insert is a removable insert which is removable from the housing, the removable insert being such that it facilitates assembly of the variable turbocharger apparatus.

14. Variable turbocharger apparatus according to claim 13 in which the removable insert is a slidable insert.

15. Variable turbocharger apparatus according to claim 13 in which the insert is held in position by spring means.

16. Variable turbocharger apparatus according to claim 15 in which the spring is such that it forms a seal for preventing gas leakage from the chamber which surrounds the turbine.

17. Variable turbocharger apparatus according to claim 12 in which the insert is a non-removable insert which is not removable from the housing.

18. Variable turbocharger apparatus according to claim 13 in which the piston passes through a bore in the insert.

19. Variable turbocharger apparatus according to claim 1 in which the piston has a first abutment for forming a seal against a mating surface thereby to prevent loss of the exhaust gases between the abutment and the mating surface.

20. Variable turbocharger apparatus according to claim 19 in which the mating surface is a mating surface on a part of the housing, or is a mating surface on the insert.

21. Variable turbocharger apparatus according to claim 19 in which the piston has a second abutment for engaging against the end of the vanes, thereby setting the gap when the piston is in its closed position.

22. Variable turbocharger apparatus according to claim 19 and including a sealing ring for forming an auxiliary seal for preventing loss of any of the exhaust gases that pass between the first abutment and the mating surface.

23. Variable turbocharger apparatus according claim 1 and including a ring on the piston for setting the size of the gap at a start condition, the ring also being such that it acts as an abutment for preventing gas leakage.

24. Variable turbocharger apparatus according to claim 1 in which the control means includes a fork member which is connected to the piston on two opposed sides, or in which the control means includes a U-shaped member which is connected to a face of the piston.

25. Variable turbocharger apparatus according to claim 1 in which the control means is an electronic control means which operates as part of an engine management control system.

26. Variable turbocharger apparatus according to claim 1 in which the chamber is a volute.

* * * * *